United States Patent [19]

Wright et al.

[11] 4,098,172

[45] Jul. 4, 1978

[54] HYDRAULIC CYLINDER ROD END FIXITY CONNECTOR FOR TELESCOPIC CRANE BOOMS

[75] Inventors: William Enterline Wright; Huber Daniel Bock, Jr., both of Hagerstown, Md.

[73] Assignee: Walter Kidde & Company, Inc., Clifton, N.J.

[21] Appl. No.: 764,829

[22] Filed: Jan. 18, 1977

Related U.S. Application Data

[63] Continuation of Ser. No. 631,199, Nov. 12, 1975, abandoned, which is a continuation-in-part of Ser. No. 511,606, Oct. 3, 1974, abandoned.

[51] Int. Cl.[2] ..... F01B 1/00; F01B 7/20

[52] U.S. Cl. ..... 92/161; 92/51; 92/66; 92/118; 92/165 PR; 212/55

[58] Field of Search ..... 91/167 R; 92/62, 66, 92/52, 53, 117 R, 117 A, 118, 146, 51, 161, 165 PR; 212/55; 214/141

[56] References Cited

U.S. PATENT DOCUMENTS

| | | | |
|---|---|---|---|
| 2,821,316 | 1/1958 | Saint | 91/167 R |
| 3,477,229 | 11/1969 | Katko | 91/167 R |
| 3,534,664 | 10/1970 | Ulinski | 92/146 |
| 3,658,189 | 4/1972 | Brown et al. | 92/52 |
| 3,777,629 | 12/1973 | Johnston | 92/146 |

OTHER PUBLICATIONS

Manual of Steel Construction, pp. 5-116-5-119, (Sixth Edition).

*Primary Examiner*—Martin P. Schwadron
*Assistant Examiner*—Abraham Hershkovitz
*Attorney, Agent, or Firm*—Brady, O'Boyle & Gates

[57] ABSTRACT

A self-aligning and end fixity connector for connecting a hydraulic cylinder piston rod to its respective boom section in a multi-section telescopic boom assembly wherein the piston rod end is rigidly and fixedly secured to a structural part of one boom section. The cylinder barrel has a lost motion connection with a next adjacent boom section whereby slight movement in a vertical direction can occur between the cylinder barrel and said next adjacent boom section. The arrangement significantly increases the column loading capacity of telescoping crane boom hydraulic cylinders and reduces significantly the tendency for cylinders to bind with their piston rods due to inevitable cocking of boom sections.

3 Claims, 5 Drawing Figures

HYDRAULIC CYLINDER ROD END FIXITY CONNECTOR FOR TELESCOPIC CRANE BOOMS

CROSS-REFERENCE TO RELATED APPLICATION

This is a continuation of application Ser. No. 631,199, filed Nov. 12, 1975, now abandoned, which in turn is a continuation-in-part of copending application Ser. No. 511,606, filed Oct. 3, 1974 now abandoned, for SELF-ALIGNING AND END FIXITY CONNECTOR FOR CONNECTING A HYDRAULIC CYLINDER PISTON ROD TO ITS RESPECTIVE SECTION IN A MULTI-SECTION TELESCOPING BOOM ASSEMBLY.

BACKGROUND OF THE INVENTION

It has been recognized in the art for some time that to eliminate binding of piston rods in their associated cylinder barrels on multi-section telescopic crane booms some form of connection other than mere pinning of rods and/or cylinder barrels to their respective boom sections must be employed in order to maintain adequate alignment. Recently in the art floating or lost motion rod connections have been devised to improve alignment of hydraulic cylinder assemblies in relation to their associated boom sections and thus lessen the requirement for extremely close and costly manufacturing tolerances in telescopic crane booms. While such floating rod connections have successfully alleviated the alignment problem, the piston rod still was not held against possible rotation about a horizontal transverse axis and this gives rise to another problem.

It is well known that column loading capacity is greatly increased when both ends of a column have end fixity. Thus, the column loading capacity of hydraulic cylinder assemblies in multi-section telescopic booms has been limited due to the non-fixity of the floating type of rod end connection.

As a result of the above, the present invention has been devised not only to provide the necessary degree of alignment under all operating conditions between the connecting points of cylinder barrels and rods with their respective boom sections, but also to provide the required end fixity at both ends of the column formed through each hydraulic cylinder assembly of a telescopic crane boom. In this manner, the invention by increasing the column load bearing efficiency of the boom assembly renders it possible to use lighter weight cylinder assemblies, thus reducing the overall weight and cost of the boom while increasing its load lifting capacity.

Other features and advantages of the invention will become apparent during the course of the following detailed description.

BRIEF DESCRIPTION OF DRAWING FIGURES

DETAILED DESCRIPTION

Figure 1:
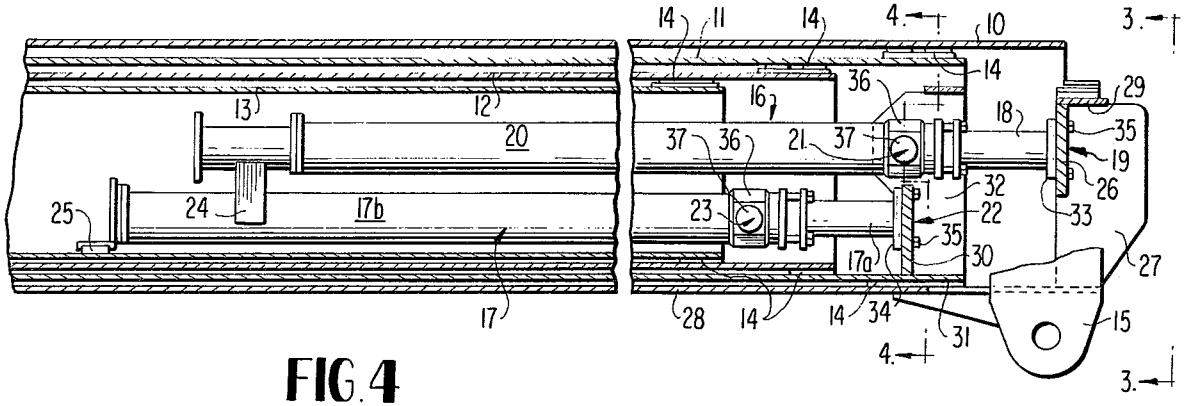
FIG. 1 is a fragmentary sectional side elevation of a multi-section telescopic boom assembly employing the self-aligning end fixity connector means of the present invention.

Referring to the drawings in detail wherein like numerals designate like parts, and referring first to FIG. 1, a multi-section telescopic crane boom assembly is illustrated, comprising a base section 10, slidably receiving an inner mid section 11 which, in turn, slidably receives an outer mid section 12 which receives a fly section 13. The sliding telescopic movement of the several boom sections is facilitated by suitable bearing pads 14 in the embodiment shown.

The base section 10 is equipped with a bracket means 15 through which the boom assembly is pivotally supported on a crane carrier turntable, not shown, for vertical swinging movement under the influence of conventional boom lift cylinders, not shown.

While FIG. 1 illustrates a four section boom assembly with two cylinder assemblies or rams 16 and 17 for the respective movement of inner mid section 11 relative to the base section 10, and of outer mid section 12 relative to inner mid section 11, it should be understood that another cylinder assembly can be connected between outer mid section 12 and fly section 13 for extending and retracting the fly section relative to the outer mid section. It should also be understood that the invention can be used on telescopic boomshaving a range of sections from two or more.

As illustrated in FIG. 1, the end of rod 18 of cylinder assembly 16 is connected to the base section 10 as at 19 and the cylinder barrel 20 of this assembly or ram is connected to the inner mid section 11 as at 21. Similarly, the cylinder assembly 17 is connected to the inner and outer mid sections 11 and 12 at 22 and 23, respectively. By this arrangement, when the assemblies 16 and 17 are actuated to either extend or retract the telescopic boom sections, the rods 18 and **17*a* are relatively stationary and the cylinder barrels 20 and 17*b* are caused to slide relative to their respective rods. This sliding movement of the cylinder assemblies with respect to each other and the boom sections is facilitated by suitable skids 24 and 25** or bearings.

Figure 2:
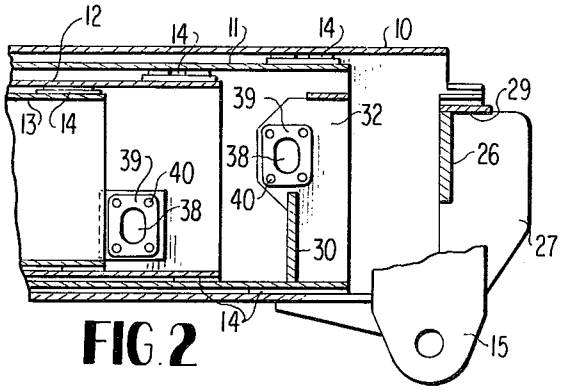
FIG. 2 is a fragmentary sectional side elevation similar to FIG. 1 with the hydraulic cylinder or ram assemblies removed to show vertical lost motion retainer plates employed in the invention.
Figure 4:
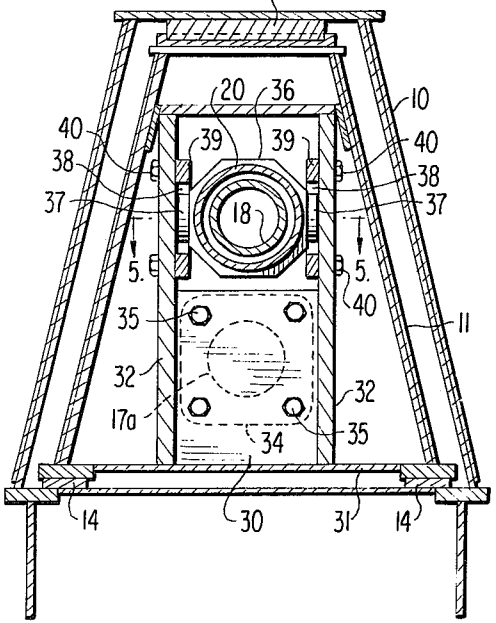
FIG. 4 is an enlarged transverse vertical section taken on line 4—4 of FIG. 1.
Figure 3:
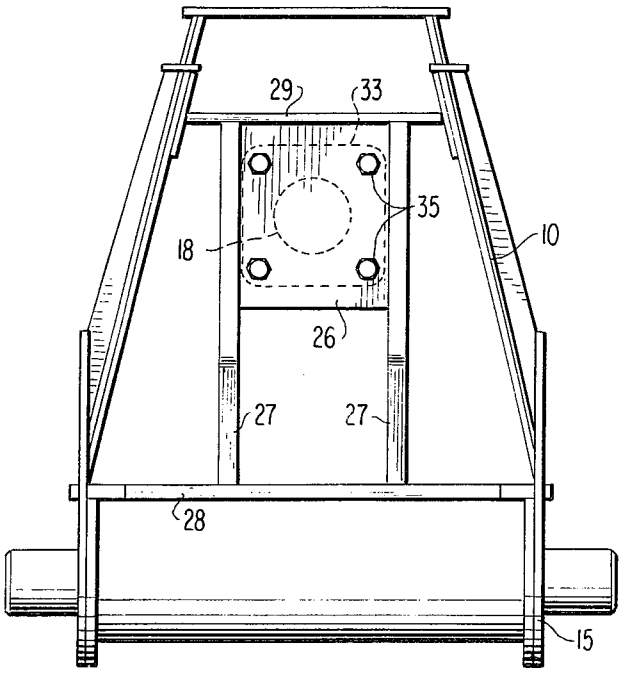
FIG. 3 is an end elevational view taken on line 3—3 of FIG. 1.

The details of connections forming the subject matter of this invention are shown particularly in the other figures of the drawings, FIG. 1 showing the general relationship of the parts. Referring to the other drawing figures, particularly FIGS. 2 and 3, it may be noted that the boom base section 10 has a fixed vertical web 26 securely welded between a pair of fixed vertical side plates 27 at the rearward end of boom section 10. The side plates 27 in turn are welded to the bottom wall 28 of base section 10 and to a horizontal web or brace 29 somewhat below the top wall of the base section. This arrangement forms a very rigid support structure for the attachment of the rod 18 to boom base section 10. Similarly, a fixed and rigid vertical web 30 near the rear end of boom inner mid section 11 forms the attachment base for the end of rod **17*a* of cylinder assembly 17. As shown in the drawings, the vertical web 30 is at a lower elevation than the web 26 and is in fact welded to the bottom plate or wall 31 of boom section 11 and also welded between a pair of spaced vertical plates 32 which are rigidly attached to the boom section 11, see FIG. 4**.

More particularly, the rods 18 and 17*a* carry end flange plates 33 and 34 which are secured fixedly near their corners by bolts 35 to the respective vertical webs 26 and 30. In this manner, the desired rod end fixity is obtained through the invention so that the column load capacity through the hydraulic cylinder assemblies of the boom structure is enhanced, as previously explained.

Figure 5:
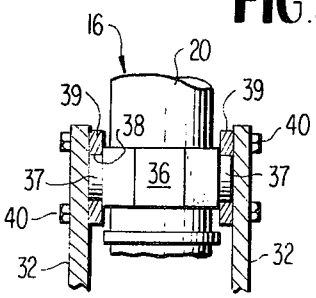
FIG. 5 is a fragmentary horizontal section taken on line 5—5 of FIG. 4.

The invention additionally includes a floating or vertical lost motion connection between cylindrical barrels 20 and 17*b* and the respective boom sections 11 and 12 at 21 and 23, as previously noted. The details of these connections are shown particularly in FIGS. 2, 4 and 5. Referring to these figures, cylinder barrels 20 and 17*b* near their rearward ends carry collars 36 to which side transverse horizontal axis trunnions 37 are rigidly secured and project outwardly therefrom. These trunnions are received in slightly vertically elongated openings 38 of flat retainer plates 39 which are bolted as at 40 or otherwise rigidly secured to the interior faces of vertical plates 32, etc. This arrangement allows the trunnions 37 to move and compensate slightly in the vertical direction relative to the boom section with which they are connected but prevents any relative movement of the trunnions fore and aft as may be noted in FIG. 5, since the openings or slots 38 are in close fitting relationship with the trunnions 37 in the horizontal plane.

The described arrangement provides the necessary self-alignment of the hydraulic cylinder assemblies to compensate for cocking of the extensible boom sections and at the same time provides the required end fixity for the piston rods so as to achieve the maximum possible column loading capacity with minimum size hydraulic cylinders.

The described lost motion connection for the cylinder barrels through trunnions 37, while allowing small vertical movement in the elongated openings 38, restrains the cylinder barrels from moving relative to their associated boom sections in other directions. That is to say, they cannot move fore and aft and cannot rotate appreciably on transverse horizontal axes or otherwise. The advantages obtained by use of the invention will be apparent to those skilled in the art, in light of the foregoing description and drawings.

The terms and expressions which have been employed herein are used as terms of description and not of limitation, and there is no intention, in use of such terms and expressions, of excluding any equivalents of the features shown and described or portions thereof but it is recognized that various modifications are possible within the scope of the invention claimed.

We claim:

1. A self-aligning and end fixity connection for a hydraulic cylinder assembly in a multi-section telescopic crane boom and wherein said cylinder assembly embodies a cylinder barrel and a piston rod slidably received therein, said connection comprising a flange plate rigidly secured to the end of said piston rod which is external to said cylinder barrel, said flange plate being disposed in a plane normal to the longitudinal axis of the rod, bolt means connecting said flange plate to an opposing fixed structural web of one boom section to thereby establish end fixity for said rod, the opposite ends of the piston rod being substantially fixed against rotational movement about a horizontal transverse axis thereby increasing the column loading capacity of the rod and associated boom section, the end of the cylinder barrel opposite from the piston rod end being slidably mounted in a boom section different from the first-mentioned boom section, additional means interposed between said piston rod connection and said opposite end of said cylinder barrel forming a limited lost motion connection between said cylinder barrel and a fixed structural part of the next adjacent boom section in a vertical direction only when the cylinder assembly and crane boom are horizontally disposed; said additional means forming said limited lost motion connection comprising, a pair of spaced vertical support plates on said next adjacent boom section, an opposing pair of retainer plates fixed to the interior face of said support plates and each retainer plate having a vertically elongted opening, and a pair of side trunnions on said cylinder barrel engaged in said openings and retained therein and adapted for limited movement lengthwise only in the elongated openings, said trunnions and openings having substantially the same widths so that said cylindrical barrel is restrained from moving in other directions relative to said next adjacent boom section.

2. A self-aligning and end fixity connection according to claim 1, and threaded fasteners fixedly attaching said retainer plates to the interior faces of said support plates.

3. A self-aligning and end fixity connection according to claim 1, and said fixed structural part of said one boom section disposed near the base end of said one section, and said fixed structural part of said next adjacent boom section disposed near the corresponding end of such boom section.

* * * * *